US009188099B2

(12) United States Patent
Ikemori et al.

(10) Patent No.: US 9,188,099 B2
(45) Date of Patent: Nov. 17, 2015

(54) STARTER

(71) Applicants: MITSUBA Corporation, Kiryu-shi, Gunma (JP); HONDA MOTOR CO., LTD., Minato-ku, Tokyo (JP)

(72) Inventors: Tomohiko Ikemori, Kiryu (JP); Hiroshi Ooka, Kiryu (JP); Masaaki Oya, Kiryu (JP); Shigehiro Kanbe, Kiryu (JP); Masataka Odagiri, Kiryu (JP); Mitsuhiro Kogure, Kiryu (JP); Hiroki Yamada, Kiryu (JP); Masahiro Nakamura, Wako (JP); Seiji Shimada, Wako (JP); Yusuke Fukada, Wako (JP); Satoshi Sekiguchi, Wako (JP)

(73) Assignees: MITSUBA CORPORATION, Kiryu-Gunma (JP); HONDA MOTOR CO., LTD., Tokyo (JP)

( * ) Notice: Subject to any disclaimer, the term of this patent is extended or adjusted under 35 U.S.C. 154(b) by 149 days.

(21) Appl. No.: 13/687,562

(22) Filed: Nov. 28, 2012

(65) Prior Publication Data

US 2013/0133479 A1 May 30, 2013

(30) Foreign Application Priority Data

Nov. 29, 2011 (JP) ..... 2011-260627
Sep. 27, 2012 (JP) ..... 2012-214804

(51) Int. Cl.
*F02N 11/00* (2006.01)
*F02N 11/02* (2006.01)
(Continued)

(52) U.S. Cl.
CPC ..... *F02N 11/02* (2013.01); *F02N 15/046* (2013.01); *F02N 15/062* (2013.01); *F02N 11/0814* (2013.01); *F02N 2015/061* (2013.01); *Y10T 74/134* (2015.01)

(58) Field of Classification Search
CPC ..... H02K 5/16; H02K 5/167; F02N 11/00; F02N 11/0814; F02N 15/046; F02N 15/062; F02N 2015/061
USPC ..... 74/7 A, 7 R, 7 E; 310/90; 384/420
See application file for complete search history.

(56) References Cited

U.S. PATENT DOCUMENTS 5,610,462 A * 3/1997 Takahashi ..... 310/90
5,684,334 A * 11/1997 Zenmei et al. ..... 290/38 R
8,302,497 B2 * 11/2012 Niimi et al. ..... 74/7 C

FOREIGN PATENT DOCUMENTS

CN 1199138 A 11/1998
CN 101557155 A 10/2009
(Continued)

OTHER PUBLICATIONS

Japanese Office Action "Notice of Reasons for Rejection", application No. 2012-214804 dated Jun. 11, 2013.
(Continued)

*Primary Examiner* — William C Joyce
(74) *Attorney, Agent, or Firm* — Squire Patton Boggs (US) LLP

(57) ABSTRACT

A starter includes an output shaft which rotates by a rotary force applied from the motor unit, a housing in which an end of the output shaft is rotatably supported, and an electromagnetic device configured to apply/shut off current to the motor unit, and biases a suppressing force toward the ring gear to the pinion gear through a clutch mechanism, wherein a load receiving member which abuts one end of the output shaft to receive an axial load generated from the output shaft is installed in the housing.

4 Claims, 5 Drawing Sheets

(51) Int. Cl.

| | |
|---|---|
| ***F02N 15/04*** | (2006.01) |
| ***F02N 15/06*** | (2006.01) |
| *F02N 11/08* | (2006.01) |

(56) References Cited

FOREIGN PATENT DOCUMENTS

| | | | | |
|---|---|---|---|---|
| CN | 202014149 | U | | 10/2011 |
| DE | 199 34 111 | A1 | | 1/2001 |
| EP | 0 878 895 | A1 | | 11/1998 |
| FR | 2 820 170 | | * | 8/2002 |
| GB | 2 077 358 | A | | 12/1981 |
| JP | 46-27936 | Y | | 9/1971 |
| JP | 08-82273 | A | | 3/1996 |
| JP | 08-100749 | A | | 4/1996 |
| JP | 10-159692 | A | | 6/1998 |
| JP | 2002-130097 | A | | 5/2002 |
| JP | 2007-071043 | A | | 3/2007 |

OTHER PUBLICATIONS

Chinese Office Action dated Oct. 29, 2014, with full English language translation, for corresponding Chinese Patent Application No. 201210489308.8.

* cited by examiner

STARTER

BACKGROUND OF THE INVENTION

1. Field of the Invention

The present invention relates to a starter loaded on an automobile, for example.

This application claims priority to and the benefit of Japanese Patent Application No. 2011-260627 filed on Nov. 29, 2011, and Japanese Patent Application No. 2012-214804 filed on Sep. 27, 2012, the disclosures of which are incorporated herein by reference.

2. Background Art

In the related art, as a starter used for starting the engine of an automobile, when start the engine, a jump-in type starter which starts the engine by jumping in the pinion gear toward the ring gear to mesh with the ring gear and driving the ring gear by the pinion gear, is known (for example, see Japanese Unexamined Patent Application, First Publication No. 2002-130097).

Recently, in order to improve the quietness or fuel efficiency of a vehicle, the number of vehicles is increasing which are provided with a so-called idle stop function for turning off the engine momentarily when the vehicle is stopping temporarily.

The starter described in Japanese Unexamined Patent Application, First Publication No. 2002-130097 can be applied even to vehicles provided with the above-mentioned idle stop function. In the starter described in Japanese Unexamined Patent Application, First Publication No. 2002-130097, a driving shaft (an output shaft) is connected to a rotor shaft of a starting motor through a planetary gear type reducer. Both ends of the driving shaft in the axial direction are rotatably supported in a housing of the starter. A mover which moves forward and backward in the axial direction through a lever by a magnet switch (an electromagnetic device) is spline-engaged to the driving shaft. Further, a pinion gear is installed in the driving shaft movably forward and backward in the axial direction toward the ring gear.

The ring gear and pinion gear are formed of helical gears. The twisting direction of the teeth of the ring gear and pinion gear is set in such a way that the thrust load of the jumping-in direction acts on the pinion gear while the pinion gear is driving the ring gear.

According to Japanese Unexamined Patent Application, First Publication No. 2002-130097, once the pinion gear is meshed with the ring gear, the pinion gear receives the thrust load generated due to the twisting angle of the teeth of both gears and moves on by itself in the jumping-in direction, thereby the meshing performance of the pinion gear with respect to the ring gear is improved.

Meanwhile, in the starter described in Japanese Unexamined Patent Application, First Publication No. 2007-71043, a second plunger unit is arranged movably forward and backward in the axial direction by a magnet switch (an electromagnetic device) installed coaxially with a driving shaft (an output shaft). A pinion gear is installed on the driving shaft movably forward and backward in the axial direction toward the ring gear.

In general, the housing of starter is made by die-cast molding of aluminum material. But in the above-described related art, when the mover is sliding toward the ring gear by receiving the thrust load generated from the helical gear, thrust load is generated even on the output shaft connected to the mover. Thus, because the output shaft is sliding toward the ring gear, there is a possibility of sliding contact between one side end face of the output shaft and the housing. Accordingly, because an abutting impact when the output shaft slides to abut the housing or a rotary force (a frictional force) of the output shaft after abutting is applied to the housing, it is necessary to improve the durability of housing. So it is also considered that the material of housing is changed to a high-grade member, or the thickness of housing is made thick. But it entails an increase of starter cost or the starter becoming bigger.

Especially in vehicles provided with an idle stop function, engine stop/start is made frequently, and the frequency of use becomes higher than that of an ordinary starter. Therefore, the best scheme of improvement is in demand for the above-mentioned task.

SUMMARY OF THE INVENTION

The present invention provides a starter which can improve the durability of housing without entailing cost increase or size increase.

According to a first aspect of the present invention, a starter includes: a motor unit which generates a rotary force by applying current, an output shaft which rotates by the rotary force applied from the motor unit, a housing in which at least one side end of the output shaft is rotatably supported, a pinion gear which is installed slidably on the output shaft and is meshed with a ring gear of an engine in a helical engaging, a clutch mechanism which is installed between the output shaft and the pinion gear to transmit the rotary force of the output shaft to the pinion gear, a movement regulation unit which is installed on the output shaft and regulates that the pinion gear and the clutch mechanism slide toward one side by equal to or larger than a predetermined value, and an electromagnetic device configured to apply or shut off a current to the motor unit, and biases a suppressing force toward the ring gear to the pinion gear through the clutch mechanism, wherein a load receiving member which is installed in the housing and contacts one side end of the output shaft to receive an axial load generated from the output shaft.

According to the above-mentioned aspect, it is possible to effectively receive the thrust load of the output shaft while regulating the movement of the output by the load receiving member installed in the housing, even when the pinion gear moves toward the meshed ring gear in a helical engaging between the pinion gear and the ring gear, and thrust load is generated on the output shaft through the movement regulation unit. Further, during the rotation of the output shaft, one side end of the output shaft and the load receiving member is in sliding contact, so it is possible to prevent direct sliding contact between one side end of the output shaft and the housing. Therefore, it is possible to obtain a starter with excellent durability while suppressing a cost increase or size increase of the housing.

According to a second aspect of the present invention, in the starter according to the first aspect of the present invention, the load receiving member is a washer.

According to the above-described aspect, it is possible to form the load receiving member simply and at low cost. Therefore, it is possible to provide at low cost a starter that can suppress a cost increase or size increase of the housing.

According to a third aspect of the present invention, in the starter according to the second aspect of the present invention, the washer is formed by press processing a metal plate. The housing has a bottom on which a main face of the washer is disposed in contact with one end of the output shaft. Further, an escape portion recessed in one side is formed at a position of the bottom corresponding to an edge portion of the washer.

According to the above-described aspect, it is possible to form the load receiving member at a further low cost by forming the washer by press processing. Since the escape portion is formed on the bottom of the housing at a position corresponding to the edge portion of the washer, it is possible to abut the main face of the washer on the bottom of the housing face to face, avoiding the interference of the burr of the washer generated during press processing with the housing. Thereby, even when one side end of the output shaft slide-contacts the washer and the washer rotated in interlock with the rotation of the output shaft, it is possible to suppress that the bottom of the housing is abraded by the burr of the washer. Therefore the durability of the housing can be further improved.

According to a fourth aspect of the present invention, the starter according to any one of the first to third aspects of the present invention includes an electromagnetic device which slides the pinion gear and the clutch mechanism along the output shaft. Further, the electromagnetic device is installed coaxially with the output shaft.

According to the above-described aspect, it can be suitably employed to a so-called uniaxial starter in which the electromagnetic device and the output shaft are installed coaxially. Therefore, also for a uniaxial starter, it is possible to obtain a starter with excellent durability while suppressing a cost increase or size increase of the housing.

According to the above-described aspect, even when the pinion gear moves toward the meshed ring gear in a helical engaging between the pinion gear and the ring gear, and thrust load is generated on the output shaft through the movement regulation unit, it is possible to receive the thrust load of the output shaft while regulating the movement of the output shaft by the load receiving member installed in the housing. Further, during the rotation of the output shaft, one side end of the output shaft and the load receiving member are in sliding contact, so it is possible to prevent direct sliding contact between one side end of the output and the housing. Therefore, it is possible to obtain a starter with excellent durability while suppressing a cost increase or size increase of the housing.

PREFERRED EMBODIMENTS

Subsequently, a starter according an embodiment of the present invention will be described with reference to the drawings.

Figure 1:
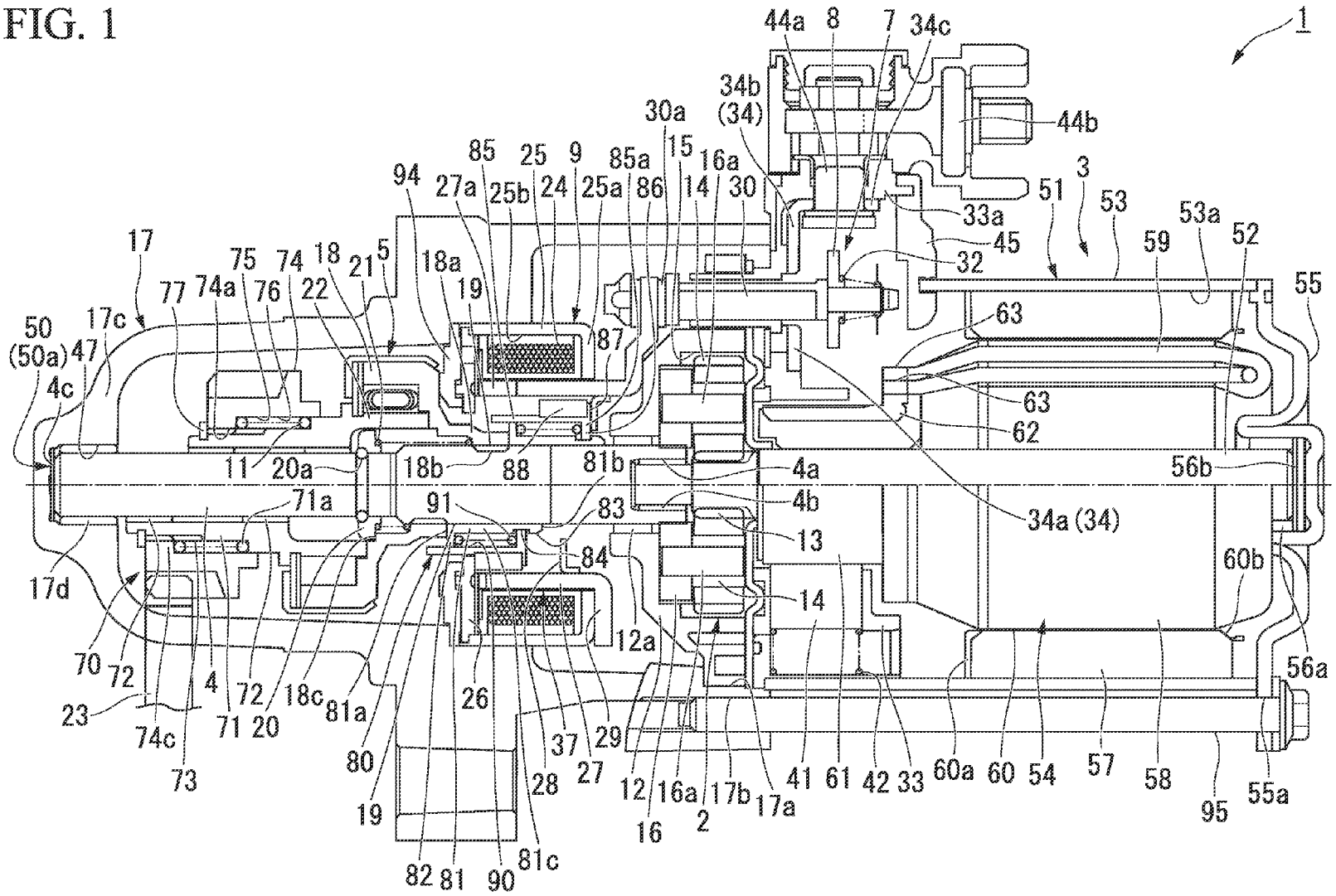
FIG. 1 is a sectional view of a starter according to an embodiment of the present invention.

FIG. 1 is a sectional view of a starter 1 according to the present embodiment. In FIG. 1, the stationary state of the starter 1 is illustrated above the center line, and the state of the current of the starter 1 being applied (the state of a pinion gear being in mesh with a ring gear) is illustrated below the center line.

As shown in FIG. 1, the starter 1 is an apparatus for generating rotary force necessary for starting an engine (not shown). The starter 1 includes a motor unit 3, an output shaft 4 connected to one side (the left side in FIG. 1) of the motor unit 3, a clutch mechanism 5 and a pinion mechanism 70 installed slidably on the output shaft 4, a switch unit 7 for opening and closing the power supply route for the motor unit 3, an electromagnetic device 9 for moving a movable contact plate 8 of the switch unit 7 and the pinion mechanism 70 in the axial direction.

The motor unit 3 includes a DC motor 51 with brush and a planetary gear mechanism 2 which is connected to a rotary shaft 52 of the DC motor 51 with brush and transmits the rotary force of the rotary shaft 52 to the output shaft 4.

The DC motor 51 with brush includes a motor yoke 53 of substantially a circular shape and an armature 54 which is disposed inward in the radial direction of the motor yoke 53 and installed rotatably with respect to the motor yoke 53. A plurality (six in the present embodiment) of permanent magnets 57 are installed on the inner circumference of the motor yoke 53 in such a way that poles are alternately arranged in the circumferential direction.

An end plate 55 for closing the opening 53*a* of the motor yoke 53 is installed in the other end portion (the right side in FIG. 1) of the motor yoke 53. A sliding bearing 56*a* and a thrust bearing 56*b* for rotatably supporting the other end of the rotary shaft 52 are installed in the center of the end plate 55 in the radial direction.

The armature 54 includes the rotary shaft 52, an armature core 58 externally fitted and fixed at a position of the rotary shaft 52 corresponding to the permanent magnets 57, and a commutator 61 externally fitted and fixed on a side of the planetary gear mechanism 2 (the left side in FIG. 1) further than the armature core 58 of the rotary shaft 52.

The armature core 58 has a plurality of teeth (not shown) formed radially, and a plurality of slots (not shown) formed between circumferentially adjoining respective teeth. A coil 59 is wound between respective slots by wave winding, for example, at a predetermined interval in the circumferential direction. The end portion of the coil 59 is drawn out toward the commutator 61.

A plurality of segments 62 (for example, 26 segments in the present embodiment) are installed in the commutator 61 in the circumferential direction at a predetermined interval so as to be electrically insulated from each other.

A riser 63 formed by bending so as to be folded back is installed at an end portion of each segment 62 on the side of the armature core 58. The end portion of the coil 59 wound on the armature core 58 is connected to the riser 63.

A top plate 12 of a cylindrical shape having a bottom is installed on the side opposite to the end plate 55 of the motor yoke 53. A planetary gear mechanism 2 is installed on the inner surface of the top plate 12 on the side of the armature core 58.

The planetary gear mechanism 2 includes a sun gear 13 formed integrally on the rotary shaft 52, a plurality of planetary gears 14 meshed with the sun gear 13 for revolving around the sun gear 13 as the center, and internal circular ring gears 15 installed on the side of the outer circumference of these planetary gears 14.

The plurality of planetary gears 14 are connected by a carrier plate 16. A plurality of support shafts 16*a* are erected on the carrier plate 16 at the positions corresponding to respective planetary gears 14. The planetary gears 14 are rotatably supported on the support shafts 16*a*. Further, the output shaft 4 is installed at the center of the carrier plate 16 in the radial direction meshed by the serration engage.

The internally-toothed ring gear 15 is formed integrally on the inner circumference of the top plate 12 on the side of the armature core 58. A sliding bearing 12*a* is installed on the inner circumference of the top plate 12 at the center in the radial direction. The sliding bearing 12*a* rotatably supports the other end (the right end in FIG. 1) of the output shaft 4 installed coaxially with the rotary shaft 52.

Further, a housing 17 made of aluminum for fixing the starter 1 to the engine (not shown) is mounted on the top plate 12, and contains the output shaft 4, the clutch mechanism 5, the pinion mechanism 70 and the electromagnetic device 9 therein. The housing 17 having a bottom 17*c* on one side (the left side in FIG. 1) and an opening 17*a* on the other side (the right side in FIG. 1) is formed in a cylinder shape having a bottom by die-cast molding.

The top plate 12 is jointed to the opening 17*a* of the housing 17 so as to close the opening 17*a*.

A female screw portion 17*b* is formed on the outer circumference of the opening 17*a* of the housing 17 in the axial direction. Further, a bolt hole 55*a* is formed in the end plate 55 disposed on the other side (the right end side in FIG. 1) of the motor yoke 53 at a position corresponding to the female screw portion 17*b*. By inserting a bolt 95 into the bolt hole 55*a* and screwing the bolt 95 to the female screw portion 17*b*, the motor unit 3 and the housing 17 are unitized.

A ring-shape stopper 94 that regulates the displacement toward the motor unit 3 of a clutch outer 18 to be described later is installed on the inner wall of the housing 17. The stopper 94 is formed of resin or rubber, and is configured so as to absorb the impact when the clutch outer 18 abutted.

Figure 2:
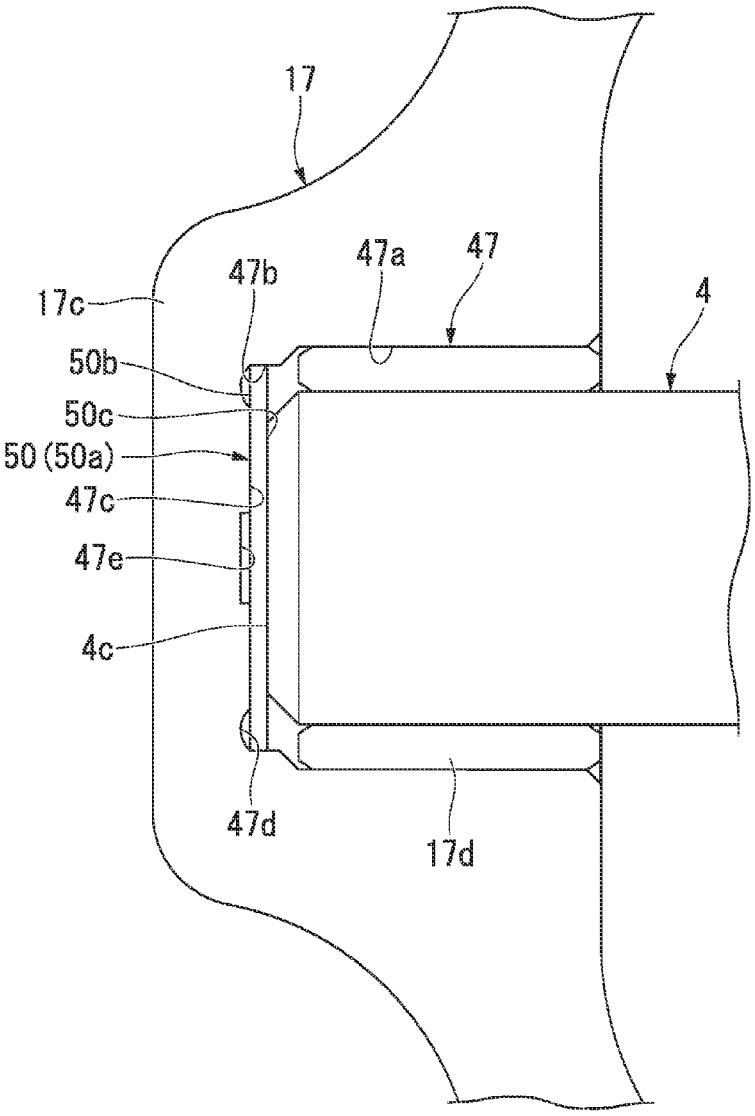
FIG. 2 is an enlarged view of a bottom of a housing, and is a view for describing a load receiving member.

FIG. 2 is an enlarged view showing the bottom 17*c* of the housing 17 and is a view for describing the load receiving member 50.

A bearing hole 47 having a bottom is formed in the bottom 17*c* of the housing 17 coaxially with the output shaft 4. The bearing hole 47 is formed in an inner diameter larger than the outer diameter of the output shaft 4. The bearing hole 47 includes a bearing insertion portion 47*a* and a load receiving member mounting portion 47*b* formed on one side (the left side in FIG. 2) of the bearing insertion portion 47*a*.

A sliding bearing 17*d* for rotatably supporting one side end (the left end in FIG. 1) of the output shaft 4 is press fitted in and fixed to the bearing insertion portion 47*a*. Lubricating oil composed of desired base oil is impregnated in the sliding bearing 17*d*, so the output shaft 4 can be slide-contacted smoothly therein.

In addition, the load receiving member mounting portion 47*b* is formed in a diameter slightly smaller than the bearing insertion portion 47*a*. The load receiving member 50 is disposed in the load receiving member mounting portion 47*b*.

The load receiving member 50 is a metal member of a flat plate shape, and employs a circular washer formed by the press, for example. The load receiving member 50 is formed of material having hardness higher than the output shaft 4 and an excellent abrasion resistance. As material of the load receiving member 50, carbon tool steel such as SK85, for example, is suitable. The load receiving member 50 is formed in thickness disposable between one side end face 4*c* of the output shaft 4 and the bottom face 47*c* of the bearing hole 47.

The load receiving member 50 is formed in a diameter substantially equal to or slightly smaller than the inner diameter of the load receiving member mounting portion 47*b*. Therefore, it is possible to insert and dispose the load receiving member 50 into the load receiving member mounting portion 47*b*.

Further, a plurality of escape portions 47*d* and 47*e* are formed on the bottom face 47*c* of the bearing hole 47. A first escape portion 47*d* is an annular groove and is formed at the position corresponding to the outer circumference of the load receiving member 50. A second escape portion 47*e* is a recessed portion and is formed at the position corresponding to the inner circumference of the load receiving member 50. The burr generated when the load receiving member 50 is formed by press can be escaped by the escape portions 47*d* and 47*e*. Therefore, one main face 50*b* of the load receiving member 50 and the bottom face 47*c* of the bearing hole 47 are brought in surface contact with each other. Thereby, as will be described later, even if the output shaft 4 moves to one side (the left side in FIG. 2), and one side end face 4*c* of the output shaft 4 and the opposite main face 50*c* of the load receiving member 50 to generate thrust load, it is possible to receive the thrust load certainly by the load receiving member 50.

Grease for reducing friction during sliding contact with one side end face 4*c* of the output shaft 4 is applied around the load receiving member 50. Meanwhile, since grease containing lubricating oil impregnated in the sliding bearing 17*d* and base oil of the same kind is used, it is possible to maintain lubricating oil of the sliding bearing 17*d* for a long time.

As shown in FIG. 1, a recessed portion 4*a* into which one side end (the left end in FIG. 1) of the rotary shaft 52 can be inserted in the other end (the right end in FIG. 1) of the output shaft 4. The sliding bearing 4*b* is press fitted on the inner circumference of the recessed portion 4*a*. The output shaft 4 and the rotary shaft 52 are connected in relatively rotatable manner.

(Clutch Mechanism)

A helical spline 19 is formed at substantially the center of the output shaft 4 in the axial direction. The clutch mechanism 5 is meshed with the helical spline 19 in a helical engaging.

The clutch mechanism 5 has a clutch outer 18 of substantially a cylinder shape and a clutch inner 22 formed coaxially with the clutch outer 18. In addition, the clutch mechanism 5 includes a so-called well-known one-way clutch function, in which the rotary force from the clutch outer 18 causes the power to be transmitted to a clutch inner 22, but the rotary force from the clutch inner 22 does not cause the power to be transmitted to the clutch outer 18. Thus, in an overrun state in which the clutch inner 22 becomes faster than the clutch outer 18 during engine start, it is configured such that the rotary force from the ring gear 23 of the engine is shut off. The clutch mechanism also has a so-called torque limiter function in which when torque difference and rotation velocity difference generated between the clutch outer 18 and the clutch inner 22 are within a predetermined value, rotary force is transmitted to each other; and when torque difference and rotation velocity difference exceed a predetermined value, transmission of rotary force is shut off.

A sleeve 18*a* with a smaller diameter is formed integrally at the other side (the right side in FIG. 1) of the clutch outer 18. A helical spline 18*b* meshed with the helical spline 19 of the output shaft 4 is formed on the inner circumference of the sleeve 18*a*. Thus, the clutch mechanism 5 is slidably installed with respect to the output shaft 4 in the axial direction. Meanwhile, the inclination angle of the helical spline 19 of the output shaft 4 and the helical spline 18*b* of the clutch outer 18 is set at about 16 degrees, for example, with respect to the axial direction.

Further, a stepped portion 18*c* is formed on the inner circumference of the clutch outer 18 on one side of the sleeve 18*a*. The inner circumference of the stepped portion 18*c* is formed in a diameter greater than the inner circumference of the sleeve 18*a*. A space is formed between the inner circumference of the stepped portion 18*c* and the outer circumference of the output shaft 4. A return spring 21 to be described later is disposed in this space.

A movement regulation unit 20 is installed on one side (the left side in FIG. 1) further than the helical spline 19 of the output shaft 4.

The movement regulation unit 20 is a member of substantially a ring shape externally fitted to the output shaft 4. The movement regulation unit 20 is installed with axial movement to one side regulated by a circlip 20*a* and is formed in a diameter greater than the inner circumference of the stepped portion 18*c* so as to be able to interfere with the stepped portion 18*c* formed on the clutch outer 18. As will be described later, when the clutch mechanism 5 has slid to one side, the stepped portion 18*c* of the clutch outer 18 and the movement regulation unit 20 interfere. Thereby, the slide displacement to one side of the clutch mechanism 5 is regulated.

The return spring 21 is disposed so as to surround the output shaft 4 in a compressed and deformed state. In this state, the return spring 21 is installed between the movement regulation unit 20 and the sleeve 18*a* of the clutch outer 18, and between the inner circumference of the stepped portion 18*c* and the outer circumference of the output shaft 4. Thereby, the clutch outer 18 is normally biased to be pushed back toward the motor unit 3.

The pinion mechanism 70 is installed integrally at the front end of the clutch inner 22 of the clutch mechanism 5 formed like above.

(Pinion Mechanism)

The pinion mechanism 70 has a pinion inner 71 of a cylinder shape formed integrally at the front end of the clutch inner 22. Two sliding bearings 72 and 72 for supporting the pinion inner 71 slidably to the output shaft 4 from both sides in the axial direction are installed on the inner circumference of the pinion inner 71.

Meanwhile, a spline 73 is formed on the front end of the outer circumference of the pinion inner 71 which is opposite to the clutch mechanism 5. A pinion gear 74 that can be meshed with the ring gear 23 of the engine (not shown) is installed on the spline 73 by spline engaging. That is, the spline 73 is formed on the front end of the pinion inner 71, and a spline 74*a* meshed with the spline 73 is formed at the front end of the inner circumference of the pinion gear 74. Thereby, the pinion inner 71 and the pinion gear 74 are installed with relative rotation impossible to each other, but slidably in the axial direction.

Here, the ring gear 23 and the pinion gear 74 are formed of a helical gear. The twisting direction of the teeth of the ring gear 23 and the pinion gear 74 is set such that the thrust load of the direction in which the pinion gear 74 jumps in the ring gear 23 while driving the ring gear 23 acts.

In addition, a large diameter portion 75 that has an enlarged diameter than the stepped portion 74*c* is formed on the inner circumference of the pinion gear 74 behind the spline 74*a*. A reception portion 76 is formed between the pinion inner 71 and the pinion gear 74.

The opening of the reception portion 76 formed on the side of the clutch mechanism 5 is closed by a stepped portion 71*a* formed on the base end of the clutch inner 22. That is, the pinion gear 74 is supported slidably in the axial direction by the pinion inner 71. Thereby, the pinion gear 74 slides in the axial direction without being shaken greatly with respect to the pinion inner 71.

A pinion spring 11 formed so as to surround the outer circumference of the pinion inner 71 is accommodated in the reception portion 76. In a state accommodated in the reception portion 76, the pinion spring 11 is compressed and deformed by the stepped portion 74*c* of the large diameter portion 75 of the pinion gear 74 and the stepped portion 71*a* of the pinion inner 71. Thereby the pinion gear 74 is biased toward the ring gear 23 with respect to the pinion inner 71.

A stop ring 77 is installed on the outer circumference of one side (the left side in FIG. 1) of the pinion inner 71. Thereby, it is regulated that the pinion gear 74 falls out toward one side of the output shaft 4 with respect to the pinion inner 71.

(Electromagnetic Device)

A yoke 25 composing the electromagnetic device 9 is internally fitted and fixed on the inner circumference of the housing 17 toward the motor unit 3 further than the clutch mechanism 5. The yoke 25 is formed of magnetic material and is formed in a shape of a barrel having a bottom. Most of the center in the radial direction of the bottom 25*a* is largely opened. An annular plunger holder 26 formed of magnetic material is installed at the end of the yoke 25 opposite to the bottom 25*a*.

An exciting coil 24 formed in substantially a cylinder shape is accommodated in a reception recessed portion 25*b* formed radially inside by the yoke 25 and the plunger holder 26. The exciting coil 24 is electrically connected to an ignition switch (all not shown) through connectors.

A plunger mechanism 37 is installed in a void between the inner circumference of the exciting coil 24 and the outer circumference of the output shaft 4 slidably in the axial direction with respect to the exciting coil 24.

The plunger mechanism 37 has a switch plunger 27 of substantially a cylinder shape formed of magnetic material, and a gear plunger 80 disposed in a void between the switch plunger 27 and the outer circumference of the output shaft 4. The switch plunger 27 and the gear plunger 80 are installed concentrically each other and relatively slidably in the axial direction. Further, a switch return spring 27*a* composed of plate spring material for biasing the switch plunger 27 toward the motor unit 3 (the right side in FIG. 1) with respect to the plunger holder 26 is installed between the plunger holder 26 and the switch plunger 27.

An outer flange portion 29 is formed integrally at the end of the switch plunger 27 on the side of the motor unit 3. Besides, a switch shaft 30 is erected in the axial direction on the outer circumference portion of the flange portion 29 through a holder member 30*a*. The switch shaft 30 passes through the top plate 12 of the motor unit 3 and a brush holder 33 to be described later. The movable contact plate 8 of the switch unit 7 disposed adjacent to the commutator 61 of the DC motor 51 with brush is connected to the end portion of the switch shaft 30 protruding from the top plate 12.

The movable contact plate 8 is mounted on the switch shaft 30 slidably in the axial direction and is supported in a floating state by a switch spring 32. In addition, the movable contact plate 8 is configured so as to be close to or far from a fixed contact plate 34 of the switch unit 7 which is fixed to a brush holder 33 to be described later.

The fixed contact plate 34 is configured in division into a first fixed contact plate 34*a* disposed radially inside which is the side of the commutator 61 and a second fixed contact plate 34*b* disposed radially outside which is the side opposite to the commutator 61 across the switch shaft 30. The movable contact plate 8 is abutted so as to span the first fixed contact plate 34*a* and the second fixed contact plate 34*b*. The movable contact plate 8 abuts the first fixed contact plate 34*a* and the second fixed contact plate 34*b*, so that the first fixed contact plate 34*a* and the second fixed contact plate 34*b* are electrically connected.

Further, a ring member 28 that becomes close to or far from the gear plunger 80 to be described later is installed integrally on the inner circumference of the switch plunger 27. The ring member 28 is a member for pressing the gear plunger 80 toward the ring gear 23 at the beginning when the switch plunger 27 moves toward the ring gear 23.

Here, the clutch outer 18 of the clutch mechanism 5 is biased toward an plunger inner 81 by the return spring 21. Accordingly, in the stationary state of the starter 1 (above the center line in FIG. 1), the clutch mechanism 5 presses the switch plunger 27 to the other side (the right side in FIG. 1) through the gear plunger 80 and the ring member 28. Thereby, the movable contact plate 8 is pressed to the other side to become farther from the fixed contact plate 34.

The gear plunger 80 disposed radially inside of the switch plunger 27 includes the plunger inner 81 disposed radially inside, an plunger outer 85 disposed radially outside, and a plunger spring 91 disposed between the plunger inner 81 and the plunger outer 85.

The plunger inner 81 is formed of resin, etc. in substantially a cylinder shape. The inner diameter of the plunger inner 81 is formed slightly larger than the outer diameter of the output shaft 4 so as to be externally fitted on the output shaft 4. Thereby, the plunger inner 81 is installed on the output shaft 4 slidably in the radial direction.

An outer flange portion 82 extending outward in the radial direction is formed integrally at one side end 81*a* (the left end in FIG. 1) of the plunger inner 81. When the plunger inner 81 slides toward one side as will be described later, one side end 81*a* of the plunger inner 81 abuts the other end of the clutch outer 18 to slide the clutch mechanism 5 and the pinion mechanism 70 to one side.

A plurality of claw portions 83 that have the outer diameter gradually increasing from one side to the other side are installed at the other end 81*b* (the right end in FIG. 1) of the plunger inner 81 in the circumferential direction. Further, a slot portion 84 is formed on one side (the left side in FIG. 1) of the claw portion 83 in the circumferential direction.

The plunger outer 85 is formed of resin, etc. in substantially a cylinder shape in the same manner as the plunger inner 81. The inner diameter of the plunger outer 85 is formed slightly larger than the outer diameter of the outer flange portion 82 of the plunger inner 81. The plunger outer 85 is externally fitted on the plunger inner 81.

An inner flange portion 86 extending inward in the radial direction is integrally formed at the other end 85*a* (the right end in FIG. 1) of the plunger outer 85. The inner diameter of the inner flange portion 86 is formed smaller than the outer diameter of the claw portion 83 of the plunger inner 81 and larger than the outer diameter of the bottom of the slot portion 84 of the plunger inner 81. When the inner flange portion 86 of the plunger outer 85 is disposed in the slot portion 84 of the plunger inner 81, the plunger inner 81 and the plunger outer 85 are unitized to configure the plunger mechanism 37.

The thickness of the inner flange portion 86 of the plunger outer 85 is formed thinner than the width of the slot portion 84 of the plunger inner 81. Thereby, clearance is formed between the inner flange portion 86 of the plunger outer 85 and the slot portion 84 of the plunger inner 81. Therefore, the plunger inner 81 and the plunger outer 85 are configured relatively slidably in the axial direction by as much as the clearance between the inner flange portion 86 of the plunger outer 85 and the slot portion 84 of the plunger inner 81.

An outer flange portion 87 extending outward in the radial direction is formed integrally at the other end 85*a* (the right end in FIG. 1) of the plunger outer 85. The outer flange portion 87 functions as an abutting portion that abuts the ring member 28 of the switch plunger 27.

Further, a ring-shape iron core 88 is formed on the outer circumference of the plunger outer 85 on one side (the left side in FIG. 1) of the outer flange portion 87. The iron core 88 is formed of resin, for example, integrally with the plunger outer 85. The iron core 88 is attracted in by the magnetic flux generated when current is supplied to the exciting coil 24 as will be described later.

A reception portion 90 is formed between the outer flange portion 82 of the plunger inner 81 and the inner flange portion 86 of the plunger outer 85. A plunger spring 91 formed so as to surround the outer circumference of the plunger inner 81 is accommodated in the reception portion 90.

The plunger spring 91 is compressed and deformed by the outer flange portion 82 of the plunger inner 81 and the inner flange portion 86 of the plunger outer 85 while it is accommodated in the reception portion 90. In addition, the plunger inner 81 facing one side (the left side in FIG. 1) and the plunger outer 85 facing the other side (the right side in FIG. 1) are biased to each other.

Thereby, as shown in FIG. 1, in the stationary state of the starter 1 (the state above the center line in FIG. 1), the plunger inner 81 facing one side (the left side in FIG. 1) and the plunger outer 85 facing the other side (the right side in FIG. 1) are biased to each other by the plunger spring 91. One side end 81*a* of the plunger inner 81 and the other end of the clutch outer 18 are not in contact. Therefore, the clutch outer 18 is pressed to the stopper 94 by the spring load of the return spring 21. Thereby, in the stationary state of the starter 1, the clutch mechanism 5 is not pushed out by the spring load of the plunger spring 91, that is, it is set in such a way that the pinion mechanism 70 is not pushed out carelessly.

In addition, in a state in which current is applied to the starter 1 (the state below the center line in FIG. 1), when the gear plunger 80 is displaced to one side (the left side in FIG. 1) to the maximum, one side end 81*a* of the plunger inner 81 normally abuts the other end of the clutch outer 18 of the clutch mechanism 5.

That is, the plunger spring 91 prevents generation of a void in the radial direction between the clutch mechanism 5 and the gear plunger 80, and configures a backlash absorption mechanism for absorbing the backlash of the clutch mechanism 5.

The brush holder 33 is installed on the other side (the right side in FIG. 1) further than the electromagnetic device 9 and the planetary gear mechanism 2. Here, a cut-raised portion 34*c* is formed on the outer circumference of the second fixed contact plate 34*b* by bending it in the axial direction to form integrally therewith. Through an insert hole of the cut-raised portion 34*c*, an axial terminal 44*a* passes through the outer wall 33*a* of the brush holder 33 and is installed so as to protrude outward in the radial direction of the starter 1. Further, a terminal bolt 44*b* to which the positive electrode of battery is electrically connected is attached to the front end of the protruded side of the axial terminal 44*a*. Meanwhile, a cover 45 for protecting the circumference of the fixed contact plate 34 and the switch shaft 30 is mounted on the brush holder 33. The brush holder 33 and the cover 45 are fixed to the motor yoke 53 and the housing 17 in a clamped state. Four brushes 41 are disposed on the brush holder 33 movably forward and backward in the radial direction around the commutator 61.

A brush spring 42 is installed at the base end of each brush 41. Each brush 41 is biased toward the commutator 61 by the brush spring 42, so the front end of each brush 41 is configured so as to slide-contact the segment 62 of the commutator 61.

The four brushes 41 include two positive brushes and two negative brushes. The two positive brushes are connected to the first fixed contact plate 34*a* of the fixed contact plate 34 through a pigtail (not shown). Meanwhile, the positive terminal of the battery (not shown) is electrically connected to the second fixed contact plate 34*b* of the fixed contact plate 34 by the terminal bolt 44*b*.

That is, when the movable contact plate 8 abuts the fixed contact plate 34, voltage is applied to the two positive brushes of the four brushes 41 through the terminal bolt 44*b*, the fixed contact plate 34 and the pigtail (not shown), so current is supplied to the coil 59.

Further, the two negative brushes of the four brushes 41 are connected to a ring-shape center plate through a pigtail (not shown). And the other two negative brushes of the four brushes 41 are electrically connected to the negative terminals of the battery through the center plate, the housing 17 and a vehicle body (not shown).

(Operation of Starter)

Next, operation of the starter 1 will be described with reference to the drawings.

As shown in the state above the center line of FIG. 1, when the starter 1 is in a stationary state before supplying current to the exciting coil 24, the clutch outer 18 biased by the return spring 21 is fully biased toward the motor unit 3 (the right side in FIG. 1), in a state in which the clutch inner 22 unitized with the pinion gear 74 is being drawn. In addition, the clutch outer 18 of the clutch mechanism 5 is stopped at the position abutted on the stopper 94, and the coupling of the pinion gear 74 and ring gear 23 is cut.

Further, in the stationary state of the starter 1, one side end 81*a* of the plunger inner 81 and the other end of the clutch outer 18 become a state having slight clearance. Therefore, the clutch outer 18 is pressed to the stopper 94 by the spring load of the return spring 21. Thereby, in the stationary state of the starter 1, the clutch mechanism 5 is set in such a way that it is not pressed by the spring load of the plunger spring 91, that is, the pinion mechanism 70 is not pushed out toward the ring gear 23 carelessly.

In addition, the switch plunger 27 is pushed back by the switch return spring 27*a* and is fully moved toward the motor unit 3 (to the right side in FIG. 1). The outer flange portion 29 of the switch plunger 27 is stopped in a state abutted to the top plate 12. Further, the movable contact plate 8 of the switch shaft 30 erected at the outer flange portion 29 is electrically cut off as it is separated from the fixed contact plate 34.

Figure 3A:
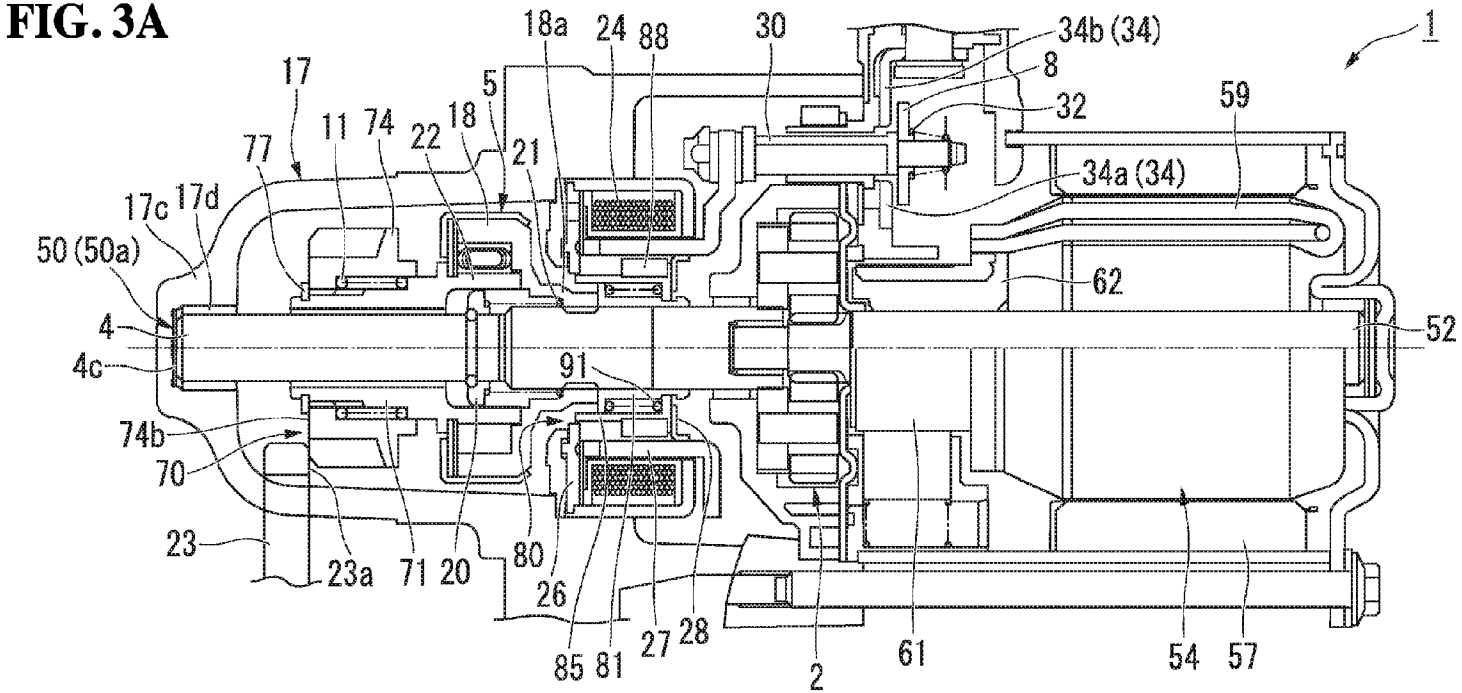
FIG. 3A is a view for describing a switch plunger immediately after it moved, and is a view for describing the operation of the starter.
Figure 3B:
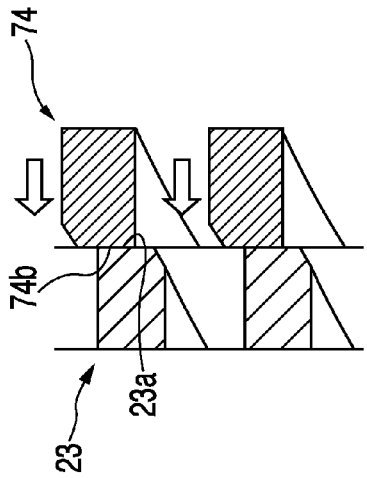
FIG. 3B is a view for describing the switch plunger immediately after it moved, and is a view for describing the operation of a pinion gear.

FIGS. 3A and 3B are views for describing the switch plunger 27 immediately after it moved. FIG. 3A is a sectional view for describing the operation of the starter 1. FIG. 3B is a view for describing the operation of the pinion gear 74. Meanwhile, FIG. 3B is a schematic view showing the pinion gear 74 and the ring gear 23 as seen from the radial direction.

When the ignition switch (not shown) of the vehicle is turned on in this state, current is supplied to the exciting coil 24 to excite the same, and a flux path for the magnetic flux to pass is formed in the switch plunger 27 and the gear plunger 80. Thereby, as shown in FIG. 3A, the switch plunger 27 and the gear plunger 80 slide toward the ring gear 23 (to the left side in FIG. 3A and FIG. 3B).

As shown in FIG. 1, in the stationary state of the starter 1, the gap (the axial clearance) between the switch plunger 27 and the plunger holder 26 is set smaller than the gap (the axial clearance) between the iron core 88 of the gear plunger 80 and the plunger holder 26 (see FIG. 1). Since the attraction force generated from the switch plunger 27 is greater than the attraction force generated from the gear plunger 80, the switch plunger 27 tries to slide prior to the gear plunger 80.

At this time, because the ring member 28 is integrally installed on the inner circumference of the switch plunger 27, the ring member 28 presses the gear plunger 80, and presses the gear plunger 80 toward the ring gear 23 at the beginning. Therefore, the switch plunger 27 and the gear plunger 80 are unitized to slide toward the ring gear 23.

In addition, the clutch outer 18 is fitted on the output shaft 4 in a helical spline engaging, and the sleeve 18*a* abuts the plunger inner 81 of the gear plunger 80. Here, the inclination angle of the helical spline 19 of the output shaft 4 and the helical spline 18*b* of the clutch outer 18 is set at about 16 degrees, for example, with respect to the axial direction. Therefore, as shown in FIG. 3A, if the switch plunger 27 and the gear plunger 80 slide toward the ring gear 23, the clutch outer 18 is pushed out while making a slight relative rotation as much as the inclination angle of the helical spline 18*b* with respect to the output shaft 4. Further, the pinion mechanism 70 is also pushed out toward the ring gear 23 in interlock with the sliding of the gear plunger 80 through the clutch mechanism 5.

At this time, the pinion gear 74 moves in a predetermined distance toward the ring gear 23 as shown in FIG. 3B. In addition, the one side end face 74*b* of one side (the left side in FIG. 3B) of the pinion gear 74 and the end face 23*a* of the other side (the right side in FIG. 3B) of the ring gear 23 abut, or become a state in which the axial dimensional distance between the one side end faces 74*b* and 23*a* is zero.

Figure 4A:
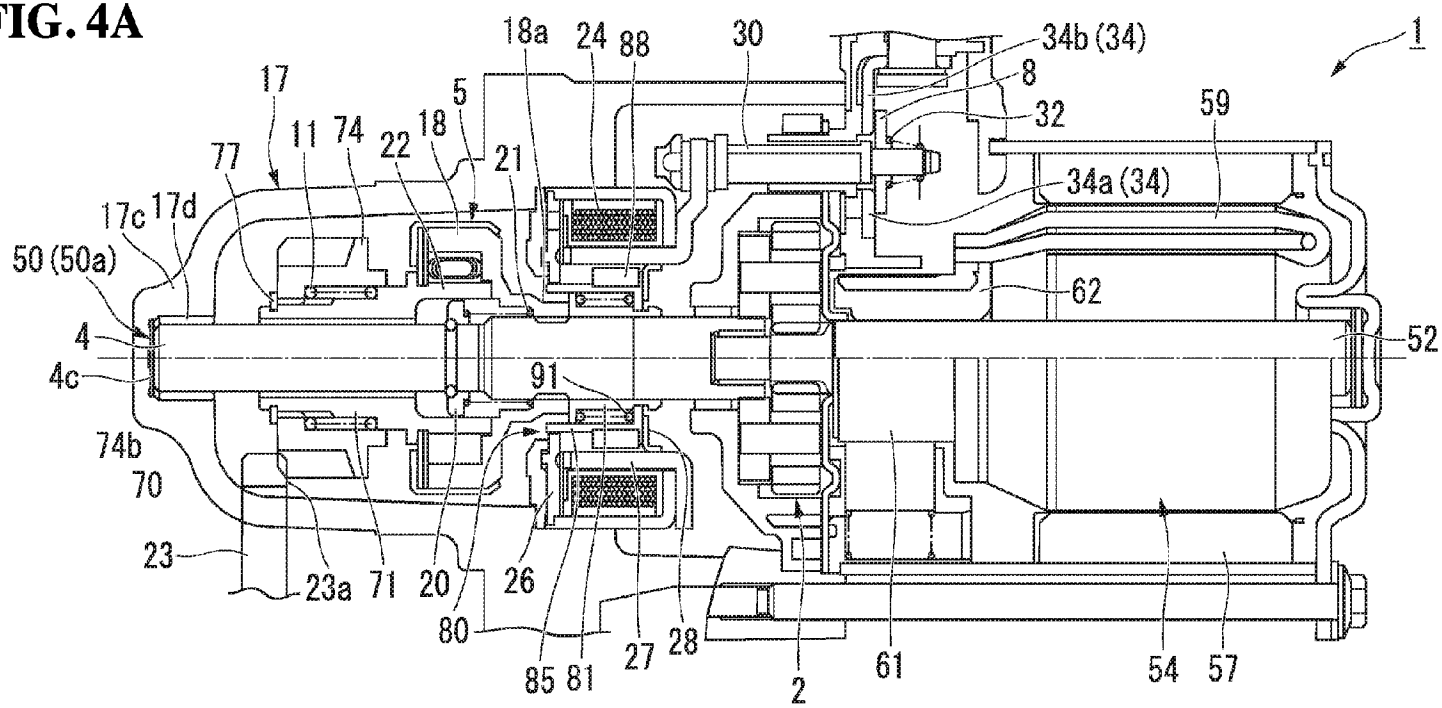
FIG. 4A is a view for describing the time at which a movable contact plate and a fixed contact plate abutted, and is a view for describing the operation of the starter.
Figure 4B:
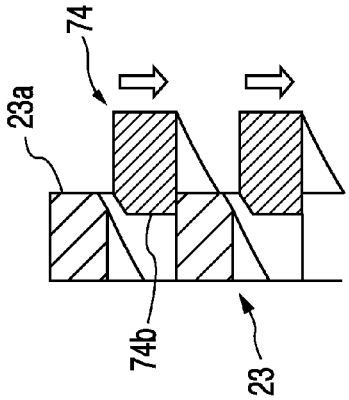
FIG. 4B is a view for describing the time at which the movable contact plate and the fixed contact plate abutted, and is a view for describing the operation of the pinion gear.

FIG. 4A and FIG. 4B are views for describing the time when the movable contact plate 8 and the fixed contact plate 34 abutted. FIG. 4A is a sectional view for describing the operation of the starter 1. FIG. 4B is a schematic view for describing the operation of the pinion gear 74.

Further, when the switch plunger 27 is attracted to slide toward the ring gear 23, the movable contact plate 8 abuts the fixed contact plate 34, as shown in FIG. 4A. Since the movable contact plate 8 is supported in a floating state displaceably in the axial direction with respect to the switch shaft 30, the biasing force of the switch spring 32 is applied to the movable contact plate 8 and the fixed contact plate 34.

At this time, one side end face 74*b* of the pinion gear 74 and the other face 23*a* of the ring gear 23 abut each other or become a state in which the axial dimensional distance between the one side end faces 74*b* and 23*a* becomes zero (see FIG. 3B). Therefore, if the pinion mechanism 70 is further pushed out by the switch plunger 27 when one side end face 74*b* of the pinion gear 74 and the other end face 23*a* of the ring gear 23 abutted each other, the pinion spring 11 is compressed. Thereby, one side end face 74*b* of the pinion gear 74 is biased toward the other end face 23*a* of the ring gear 23. That is, the pinion spring 11 configures a damper mechanism for absorbing the thrust load when the pinion gear 74 and the ring gear 23 abutted. Thereby, even if one side end face 74*b* of the pinion gear 74 and the other end face 23*a* of the ring gear 23 abutted each other, it is possible to push out the switch plunger 27 to a predetermined position. At the same time, it is possible to suppress the abrasion of one side end face 74*b* of the pinion gear 74 and the other end face 23*a* of the ring gear 23, and improve the durability of the starter 1.

Subsequently, as shown in FIG. 4A, when the movable contact plate 8 comes into contact with the fixed contact plate 34, voltage of the battery (not shown) is applied to the two positive brushes of the four brushes 41, and current flows in the coil 59 through the segment 62 of the commutator 61.

Then, a magnetic field is generated in the armature core 58. Magnetic attraction force or repulsive force is generated between the magnetic field and the permanent magnet 57 installed in the motor yoke 53. Thereby, the armature 54 starts to rotate. As the armature 54 rotates, the rotary force of the rotary shaft 52 of the armature 54 is transmitted to the output shaft 4 through the planetary gear mechanism 2, and the output shaft 4 starts to rotate.

After the output shaft 4 started rotating, if one side end face 74*b* of the pinion gear 74 and the other end face 23*a* of the ring gear 23 abutted each other, the abutted state (see FIG. 3B) is released. Then, as shown in FIG. 4B, the pinion gear 74 is pushed out toward the ring gear 23 by the biasing force of the pinion spring 11, and the pinion gear 74 and the ring gear 23 start to be meshed.

Figure 5A:
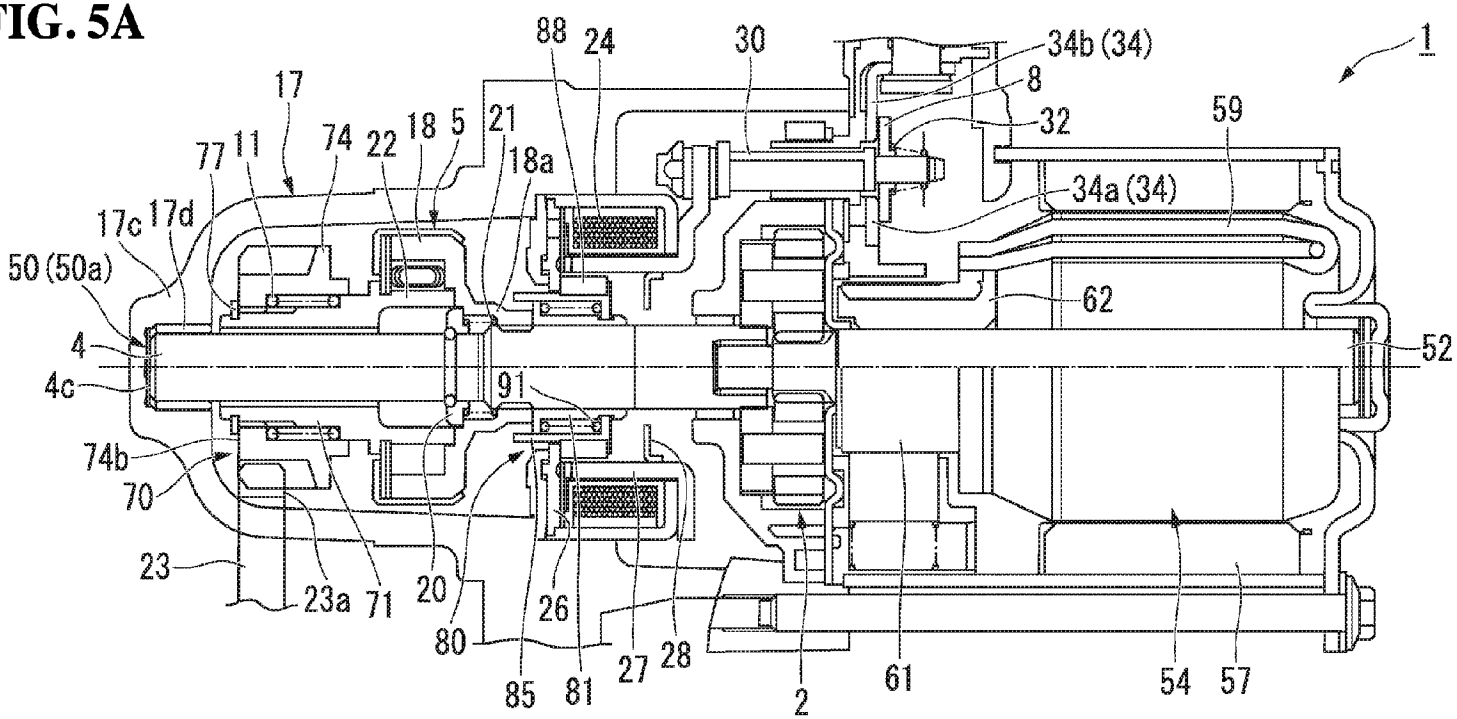
FIG. 5A is a view for describing the time at which the pinion gear and a ring gear are meshed, and is a view for describing the operation of the starter.
Figure 5B:
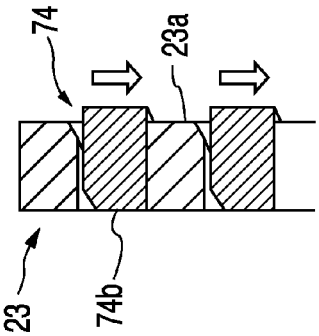
FIG. 5B is a view for describing the time at which the pinion gear and the ring gear are meshed, and is a view for describing the operation of the pinion gear.

FIG. 5A and FIG. 5B are views for describing the time when the pinion gear 74 and the ring gear 23 are meshed. FIG. 5A is a sectional view for describing the operation of the starter 1. FIG. 5B is a schematic view for describing the operation of the pinion gear 74.

If the rotation velocity of the output shaft 4 rises, inertial force acts on the clutch outer 18 meshed with the helical spline 19 of the output shaft 4. At this time, as described above, since the pinion gear 74 and the ring gear 23 are meshed in a helical engaging, thrust force in the direction (jump-in direction) of the ring gear 23 is generated. Therefore, the pinion gear 74 is moved by the thrust force toward the ring gear 23 (to the left side in FIGS. 5A and 5B) against the biasing force of the return spring 21 so as to follow the helical spline 19. Further, as shown in FIG. 5A, the clutch outer 18 is also pushed out by inertial force toward the ring gear 23 (to the left side in FIGS. 5A and 5B) against the biasing force of the return spring 21 so as to follow the helical spline 19.

At this time, the attraction force toward the ring gear 23 is acting on the gear plunger 80. Therefore, the gear plunger 80 slides toward the ring gear 23 while pressing the clutch outer 18 so as to be interlocked with the sliding of the clutch outer 18.

Thereby, as shown in FIG. 5B, the pinion gear 74 and the ring gear 23 are meshed at a predetermined meshing position.

Here, because the pinion gear 74 and the ring gear 23 are meshed in a helical engaging, thrust load is generated in the pinion gear 74 toward one side (the left side in FIGS. 5A and 5B) when the rotary force of the output shaft 4 is transmitted from the pinion gear 74 to the ring gear 23. The thrust load generated from the pinion gear 74, after it is transmitted to the stop ring 77 installed on one end of the pinion gear 74, is transmitted to the output shaft 4 through the pinion inner 71, the clutch inner 22, the clutch outer 18, the movement regulation unit 20, and the circlip 20*a*. Therefore, thrust load is generated in the output shaft 4 toward one side (to the left side in FIGS. 5A and 5B), and the output shaft 4 slides toward one side.

Especially in a vehicle equipped with an idle stop function, engine stop/start is made frequently, and use frequency becomes higher than an ordinary starter. Therefore, the sliding of the output shaft 4 is made frequently.

However, as shown in FIG. 2, the load receiving member 50 is installed in the bottom 17*c* of the housing 17. Thereby, one side end face 4*c* of the output shaft 4 abutted on the load receiving member 50, and the sliding toward one side of the output shaft 4 (to the left side in FIGS. 5A and 5B) is regulated.

When engine is started and the rotation velocity of the pinion gear 74 exceeds the rotation velocity of the output shaft 4, the one-way clutch function of the clutch mechanism 5 operates to make the pinion gear 74 revolve. Further, when current flow to the exciting coil 24 is stopped as engine is started, the pinion gear 74 is separated from the ring gear 23 by the biasing force of the return spring 21 to the clutch outer 18. At the same time, the movable contact plate 8 is separated from the fixed contact plate 34, and the DC motor 51 with brush stops.

(Effectiveness)

According to the present embodiment, even when the pinion gear 74 is meshed with the ring gear in a helical engaging to move toward the ring gear 23, and thrust load is generated in the output shaft 4 through the stop ring 77, the pinion inner 71, the clutch inner 22, the clutch outer 18 and the movement regulation unit 20, it is possible to receive the thrust load of the output shaft 4 effectively while regulating the movement of the output shaft 4 by the load receiving member 50 installed in the housing 17. Further, during the rotation of the output shaft 4, one side end face 4*c* of the output shaft 4 and the load receiving member 50 slide-contact, so it is possible to prevent direct slide-contact between one side end face 4*c* of the output shaft 4 and the housing 17. Therefore, it is possible to obtain a starter with excellent durability while suppressing cost increase and size increase of the housing 17.

In addition, according to the present embodiment, it is possible to form the load receiving member 50 simply and at low cost. Therefore, it is possible to provide a starter 1 whereby it is possible to suppress cost increase and size increase of the housing 17.

Further, by forming the washer by press processing, it is possible to form the load receiving member 50 at a further low cost. In addition, escape portions 47*d* and 47*e* are formed in the bottom 17*c* of the housing 17 at the position corresponding to the edge portion of the washer. Therefore, the interfering of the housing 17 and the burr of washer generated during press processing is avoided, and one main face 50*b* of washer and the bottom 17*c* of the housing 17 can abut face to face. Thereby, one side end face 4*c* of the output shaft 4 and the washer 50*a* slide-contact, and also when the washer 50*a* rotated in interlock with the rotation of the output shaft 4, the abrading of the bottom 17*c* of the housing 17 can be suppressed by the burr of the washer 50*a*. Therefore, durability of the housing 17 is improved.

Meanwhile, the present invention is not limited to the embodiment described above, and includes various modifications of the above-described embodiment within the range not departing from the purpose of the present invention.

The present embodiment has been described a so-called uniaxial starter 1, in which the electromagnetic device 9 includes the exciting coil 24, the plunger mechanism 37 and the switch unit 7, and the plunger mechanism 37 and the output shaft 4 are coaxially disposed.

However, the application of the present invention is not limited to the uniaxial starter 1, but it is possible to apply the present invention to any starter if it includes the configuration in which it is possible to move the pinion mechanism 70 forward and backward. For example, the present invention may be applied to starters of various types such as a so-called biaxial starter in which the axis of the electromagnetic device (the plunger mechanism 37) and the output shaft 4 are disposed on different axes and a so-called triaxial starter in which the axis of the electromagnetic device (the plunger mechanism 37), the rotary shaft 52 and the output shaft 4 are disposed on different axes.

The present embodiment has been described the case in which the helical spline 19 is formed on the output shaft 4, the helical spline 18*b* is formed on the clutch outer 18, and the clutch mechanism 5 is inserted into the output shaft 4 in a helical spline engaging, so that the clutch mechanism 5 is installed slidably in the axial direction with respect to the output shaft 4. At this time, the inclination angle of the helical spline 19 of the output shaft 4 and the helical spline 18*b* of the clutch outer 18 are set at about 16 degrees with respect to the axial direction, but is not limited thereto. The inclination angle for the helical spline 19 of the output shaft 4 and the helical spline 18*b* of the clutch outer 18 may be set in such a way that the clutch outer 18 is pushed out while making a slight relative rotation with respect to the output shaft 4 when the switch plunger 27 and the gear plunger 80 started to slide toward the ring gear 23.

In the present embodiment, the spline 73 is formed on the front end of the pinion inner 71. Meanwhile, the spline 74*a* meshed with the spline 73 is formed on the front end of the inner circumference of the pinion gear 74. Thereby, the pinion inner 71 and the pinion gear 74 are installed slidably in the axial direction while mutual relative rotation is impossible.

However, as described above, it is not limited to the case in which the pinion inner 71 and the pinion gear 74 are formed slidably by spline engaging. For example, a key is formed in the pinion inner 71 and a key slot is formed in the pinion gear 74, so that the pinion inner 71 and the pinion gear 74 may be formed slidably.

The present embodiment is described taking the starter 1 used for the automobile engine start as an example. However, the starter 1 is not limited to the case applied to the automobile, it may be applied to the motorcycle, for example.

Further, the starter 1 of the present embodiment, as described above, has a structure in which the pinion gear 74 moves toward the ring gear 23, and also when thrust load is generated in the output shaft 4, the thrust load of the output shaft 4 is received while the movement of the output shaft 4 is regulated by the load receiving member 50. Therefore, the starter 1 can be properly applied to an automobile equipped with an idle stop function that has a high frequency of use.

While preferred embodiments of the present invention have been described, the present invention is not limited to the embodiments. Additions, omissions, substitutions, and other variations may be made to the present invention without departing from the spirit and scope of the present invention. The present invention is not limited by the above description, but only by the appended claims.

The invention claimed is:

1. A starter comprising:

a motor unit which generates a rotary force by applying current;

an output shaft which rotates by the rotary force applied from the motor unit;

a housing in which at least one side end of the output shaft is rotatably supported;

a pinion mechanism configured with a pinion gear having helical teeth, the pinion gear being installed slidably on the output shaft and is meshed with a ring gear of an engine in a helical engagement, a pinion inner member which is provided unrotatable relative to the pinon gear while slidable in the axial direction relative to the pinion gear, and a pinion spring which is provided between the pinon gear and the pinion inner member;

a clutch mechanism which is installed between the output shaft and the pinion mechanism to transmit the rotary force of the output shaft to the pinion mechanism;

a movement regulation unit which is installed between the output shaft and the clutch mechanism and regulates that the pinion mechanism and the clutch mechanism slide toward one side by equal to or larger than a predetermined value by interfering with the clutch mechanism; and an electromagnetic device configured to apply or shut off a current to the motor unit, and biases a suppressing force toward the ring gear to the pinion gear through the clutch mechanism, wherein the pinion spring is configured as a damper mechanism upon the pinion gear abutting the ring gear, and wherein a load receiving member is installed in the housing, the load receiving member which contacts an end surface of the output shaft to receive a thrust load generated from the output shaft, when the thrust load generated in the pinion gear towards one side of the output shaft by meshing between the pinion gear and the ring gear in a helical engagement is transmitted from the pinion gear to the output shaft through the clutch mechanism and the movement regulation unit.

2. The starter according to claim 1, wherein the electromagnetic device is installed coaxially with the output shaft.

3. The starter according to claim 1, wherein the electromagnetic device is installed coaxially with the output shaft.

4. The starter according to claim 1, wherein the housing is provided with a load receiving member mounting portion;

wherein a load receiving member is inserted in the housing as having a gap between the load receiving member and the inner wall of the load receiving member mounting portion.

* * * * *